US009793621B2

(12) United States Patent
Kumar et al.

(10) Patent No.: US 9,793,621 B2
(45) Date of Patent: Oct. 17, 2017

(54) MINING CABLE COUPLER CONNECTORS AND RELATED ASSEMBLIES AND METHODS

(71) Applicants: Tyco Electronics Corporation, Berwyn, PA (US); TYCO ELECTRONICS CANADA ULC, Markham, Ontario (CA); Tyco Electronics Industrial Y Comercial Chile Limitada, Providencia, Santiago (CL)

(72) Inventors: Senthil A. Kumar, Morrisville, NC (US); Barry James Johnson, Vaughan (CA); Juan Darritchon, Santiago (CL)

(73) Assignees: TE Connectivity Corporation, Berwyn, PA (US); Tyco Electronics Canada ULC, Markham, Ontario (CA); Tyco Electronics Industrial Comercial Chile Limitada, Providencia, Santiago (CL)

( * ) Notice: Subject to any disclaimer, the term of this patent is extended or adjusted under 35 U.S.C. 154(b) by 0 days.

(21) Appl. No.: 15/133,799

(22) Filed: Apr. 20, 2016

(65) Prior Publication Data

US 2016/0308289 A1 Oct. 20, 2016

Related U.S. Application Data

(60) Provisional application No. 62/150,114, filed on Apr. 20, 2015.

(51) Int. Cl.
*H01R 13/58* (2006.01)
*H01R 4/58* (2006.01)
(Continued)

(52) U.S. Cl.
CPC ..... *H01R 4/58* (2013.01); *H01R 4/36* (2013.01); *H01R 13/187* (2013.01);
(Continued)

(58) Field of Classification Search
CPC ..... H01R 11/15; H01R 13/53
(Continued)

(56) References Cited

U.S. PATENT DOCUMENTS 2,695,390 A 11/1954 Woolston et al.
2,722,667 A * 11/1955 Huston ..... H01R 13/627 439/252
(Continued)

FOREIGN PATENT DOCUMENTS

AU 648137 4/1994
CN 102544943 7/2012
(Continued)

OTHER PUBLICATIONS

International Search Report and Written Opinion Corresponding to International Application No. PCT/US2016/028391; Date of Mailing: Sep. 8, 2016; 18 Pages.
Invitation to Pay Additional Fees with Partial International Search for PCT/US2016/028391 mailed Jul. 18, 2016, 8 pages.
(Continued)

*Primary Examiner* — Phuong Dinh
(74) *Attorney, Agent, or Firm* — Myers Bigel, PA

(57) ABSTRACT

A connector assembly for use with a mining cable coupler includes a first connector and a second connector. The first connector includes a front portion including a plug and a rear portion including a barrel configured to receive a first conductor. The second connector includes a front portion including a socket having a channel defined therein and a rear portion including a barrel configured to receive a second conductor. An annular groove is defined in an inner surface of the channel. An annular spring held in the annular groove. The channel is sized and configured to receive the plug such
(Continued)

that the plug resiliently contacts the spring to electrically connect the first conductor received in the first connector barrel and the second conductor received in the second connector barrel.

18 Claims, 8 Drawing Sheets

(51) Int. Cl.

| | |
|---|---|
| ***H01R 4/36*** | (2006.01) |
| ***H01R 24/86*** | (2011.01) |
| ***H01R 13/187*** | (2006.01) |
| ***H01R 13/533*** | (2006.01) |
| *H01R 105/00* | (2006.01) |
| *H01R 24/20* | (2011.01) |

(52) U.S. Cl.
CPC ..... *H01R 13/533* (2013.01); *H01R 24/86* (2013.01); *H01R 24/20* (2013.01); *H01R 2105/00* (2013.01)

(58) Field of Classification Search
USPC ..... 439/475, 801
See application file for complete search history.

(56) References Cited

U.S. PATENT DOCUMENTS

| | | | | |
|---|---|---|---|---|
| 3,196,381 | A * | 7/1965 | Steinhardt | H01R 13/746 439/551 |
| 4,420,202 | A | 12/1983 | Atakkaan | |
| 4,810,213 | A * | 3/1989 | Chabot | H02B 11/04 439/825 |
| 5,458,507 | A | 10/1995 | Colescott et al. | |
| 2009/0149053 | A1 | 6/2009 | Chansrivong | |
| 2014/0017952 | A1 | 1/2014 | Spalding | |
| 2014/0141658 | A1* | 5/2014 | Bazenas | H01R 13/111 439/730 |
| 2014/0179148 | A1 | 6/2014 | Huang | |

FOREIGN PATENT DOCUMENTS

| | | |
|---|---|---|
| GB | 561307 | 5/1944 |
| GB | 2 108 331 A | 5/1983 |
| GB | 2108331 | 5/1983 |
| JP | 2015015085 | 1/2015 |

OTHER PUBLICATIONS

Brochure, "Raychem Dry Compact Switchgear & Transformer Termination PHVS & PHVT up to 245kV" , Tyco Electronics Raychem GmbH, 2013, 2 pages.

* cited by examiner

MINING CABLE COUPLER CONNECTORS AND RELATED ASSEMBLIES AND METHODS

RELATED APPLICATIONS

This application claims priority to U.S. Provisional Application No. 62/150,114, filed Apr. 20, 2015, the disclosure of which is incorporated by reference in its entirety.

BACKGROUND

In the mining industry, heavy equipment is powered using mining cables and couplers that provide a three-phase, deadbreak, plug and socket style connection. The couplers are typically used to terminate SHD-GC mining cables that carry three phase conductors, at least one ground conductor and at least one pilot conductor. Each of these conductors are multi-stranded Class I or DLO cable that can have about 1225 strands for a 500 kemil wire.

The conductors are terminated on a suitable connector to make the electrical connection. The connectors typically include a plug or pin member that mates with a socket or receptacle member. Each of the plug and socket connector members have previously used a two-piece design having a front mating part (or front end portion) and a rear cable part (or rear end portion) that are threadingly engaged and possibly sealed to help prevent moisture from entering the connector.

The front end portions of the connectors typically use a tulip (finger-style) or a louvertac band (multilam) style contact interface. The tulip style interface has a high mating force issue and requires a closing tool during connection. The tulip style interface also introduces breaks in contact between the fingers (i.e., the contact between the plug and socket is not continuous). The louvertac band style interface requires less force during mating but there are concerns about performance under contaminated conditions that are found in a mine. The louvertac band style interface also can have breaks in contact due to offset issues associated with the multilam design.

The rear end portions of the connectors are typically soldered due to the fine-stranded nature of the cable. This requires skilled labor and introduces contact pressure repeatability problems (e.g., due to cold solder resulting in poor contact pressure). Another approach has been to use hex bolts that are tightened by an allen wrench. However, it is difficult to consistently tighten the bolts to the specified torque to ensure the proper contact pressure.

SUMMARY

Some embodiments of the present invention are directed to a connector assembly for use with a mining cable coupler. The assembly includes a first connector and a second connector. The first connector includes a front portion including a plug and a rear portion including a barrel configured to receive a first conductor. The second connector includes a front portion including a socket having a channel defined therein and a rear portion including a barrel configured to receive a second conductor. An annular groove is defined in an inner surface of the channel. An annular spring is held in the annular groove. The channel is sized and configured to receive the plug such that the plug resiliently contacts the spring to electrically connect the first conductor received in the first connector barrel and the second conductor received in the second connector barrel.

In some embodiments, each of the first and second connectors is monolithic.

The first connector may include a central portion between the front portion and the rear portion. The central portion may include a threaded region on an outer surface thereof. The threaded region may be configured to threadingly engage with a fastener such that the fastener is held around the central portion of the first connector. The second connector may include a central portion between the front portion and the rear portion. The central portion may include a threaded region on an outer surface thereof. The threaded region may be configured to threadingly engage with a fastener such that the fastener is held around the central portion of the second connector.

In some embodiments, each of the first and second connector barrels comprise a plurality of shear bolt holes configured to receive shear bolts for securing ends of the first and second conductor in the first and second connector barrels, respectively.

In some embodiments, the assembly is in combination with the first conductor including the first conductor end held in the first connector barrel and/or the second conductor including the second conductor end held in the second connector barrel. Each of the first and second conductor ends may include a plurality of strands. A shielding mesh layer may be wrapped around the plurality of strands of each of the first and second conductor ends to secure the strands together.

In some embodiments, the spring is a canted coil spring. In some embodiments, the spring is silver-plated.

In some embodiments, a plurality of spaced apart annular grooves are defined in the inner surface of the socket channel and a spring is held in each of the plurality of annular grooves.

The first connector may include a central portion between the front portion and the rear portion and the front portion and central portion may be threadingly engaged with one another. The second connector may include a central portion between the front portion and the rear portion and the front portion and central portion may be threadingly engaged with one another.

Some other embodiments of the present invention are directed to a mining cable coupler assembly. The assembly includes an outer housing. The outer housing includes a first tube shaped housing having first and second opposite ends. The outer housing includes a second tube shaped housing having first and second opposite ends with an elongated annular slot defined in an outer wall of the first end. The first and second housings are coupled at least in part by the first end of the first housing being received in the annular slot of the second housing. The assembly includes a first connector held in the first housing and a second connector held in the second housing. The first connector includes a rear portion including a barrel configured to receive a first conductor, a front portion including one of a plug and a socket, and a central portion between the rear portion and the front portion. The second connector includes a rear portion including a barrel configured to receive a second conductor, a front portion including the other one of a plug and a socket, and a central portion between the rear portion and the front portion. The first and second connectors are coupled by the plug of one of the first and second connectors being received in the socket of the other one of the first and second connectors.

The first housing may include an annular projection extending inwardly from the outer wall between the first and second ends, a central channel defined by the annular projection, a first end channel defined by the outer wall between the first end and the annular projection, and a second end channel defined by the outer wall between the second end and the annular projection. The second housing may include an annular projection extending inwardly from an outer wall between the first and second ends, a central channel defined by the annular projection, a first end channel defined by the outer wall between the first end and the annular projection, and a second end channel defined by the outer wall between the second end and the annular projection.

The first connector may be held in the first housing with the front portion of the first connector in the first end channel of the first housing and/or the first end portion of the second housing, the central portion of the first connector in the central channel of the first housing, and the rear portion of the first connector in the second end channel of the first housing. The second connector may be held in the second housing with the front portion of the second connector in the first end channel of the second housing and/or the first end portion of the first housing, the central portion of the second connector in the central channel of the second housing, and the rear portion of the second connector in the second end channel of the second housing.

In some embodiments, each of the first and second connectors is a one-piece connector. The central portion of the first connector may include a threaded region on an outer surface thereof and a first fastener may be threadingly engaged with the threaded region. The central portion of the second connector may include a threaded region on an outer surface thereof and a second fastener may be threadingly engaged with the threaded region.

The first fastener may be adjacent and/or abut a first wall defined by the annular projection of the first housing and the rear portion of the first connector may be adjacent and/or abut a second, opposite wall of the annular projection of the first housing. The second fastener may be adjacent and/or abut a first wall defined by the annular projection of the second housing and the rear portion of the second connector may be adjacent and/or abut a second, opposite wall of the annular projection of the second housing.

In some embodiments, the assembly includes a plurality of the outer housings with one of the first connectors and one of the second connectors coupled and held in each one of the outer housings. The plurality of outer housings may be held together by a first base plate that engages the outer wall of each of the first housings and a second base plate that engages the outer wall of each of the second housings.

The socket of one of the first and second connectors may include a channel with an annular groove defined in an inner wall of the channel. A spring may be held in the annular groove. The plug of the other one of the first and second connectors may resiliently contact the spring to electrically connect the first conductor received in the first connector barrel and the second conductor received in the second connector barrel.

Some other embodiments of the present invention are directed to a method for electrically connecting mining cables. The method includes (a) providing: a first connector comprising a front portion including a plug and a rear portion including a barrel; a second connector comprising a front portion including a socket having a channel defined therein and a rear portion including a barrel, wherein an annular groove is defined in an inner surface of the channel; an annular spring held in the annular groove; a first tube shaped housing having first and second opposite ends with an elongated annular slot defined in an outer wall of the first housing at the first end; and a second tube shaped housing having first and second opposite ends. The method includes: (b) receiving a first mining cable conductor in the barrel of the first connector; (c) securing the first mining cable conductor in the barrel of the first connector; (d) inserting the first connector with the secured first mining cable conductor into the second end of the first housing toward the first end of the first housing such that the plug is adjacent the first end of the first housing; (e) receiving a second mining cable conductor in the barrel of the second connector; (f) securing the second mining cable conductor in the barrel of the second connector; (g) inserting the second connector with the secured second mining cable conductor into the second end of the second housing toward the first end of the second housing such that the socket is adjacent the first end of the second housing; (h) coupling the first and second housings including receiving the first end of the second housing in the annular slot of the first housing; and (i) coupling the first and second connectors including receiving the plug of the first connector in the socket of the second connector such that the plug resiliently contacts the spring to electrically connect the first mining cable conductor and the second mining cable conductor.

In some embodiments, the method includes wrapping a shielding mesh layer around the first cable mining cable conductor before step (b) and wrapping a shielding mesh layer around second cable mining cable conductor before step (e). Step (c) may include receiving shear bolts through shear bolt apertures defined in the barrel of the first connector and tightening the shear bolts. Step (f) may include receiving shear bolts through shear bolt apertures defined in the barrel of the second connector and tightening the shear bolts.

In some embodiments, the method includes providing: three of the first connectors; three of the second connectors; three of the annular springs, one each held in a respective annular groove of a respective second connector; three of the first tube shaped housings; and three of the second tube shaped housing. The method may include performing steps (b) through (i) for each of the first connectors, second connectors, first housings, and second housings. The method may include securing the first housings with a first base plate that engages the outer surfaces of the first housing. The method may include securing the second housings with a second base plate that engages outer surfaces of the second housings.

Further features, advantages and details of the present invention will be appreciated by those of ordinary skill in the art from a reading of the figures and the detailed description of the preferred embodiments that follow, such description being merely illustrative of the present invention.

DETAILED DESCRIPTION OF EMBODIMENTS OF THE INVENTION

Figure 1:
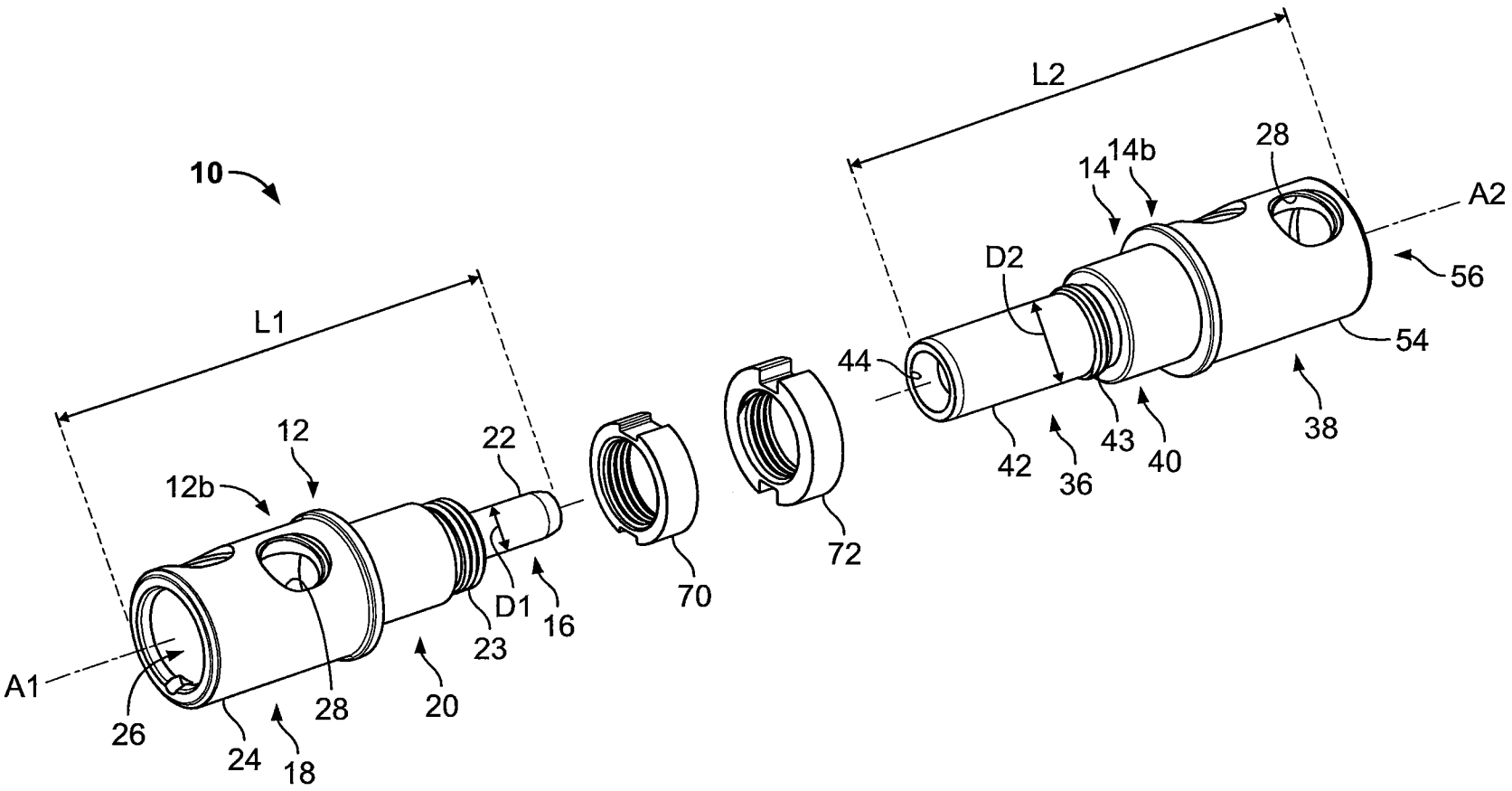
FIG. 1 is an exploded perspective view of a mining cable coupler connector according to some embodiments.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present. Like numbers refer to like elements throughout. As used herein the term "and/or" includes any and all combinations of one or more of the associated listed items.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises," "includes," "comprising," and/or "including," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

It is noted that any one or more aspects or features described with respect to one embodiment may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail in the specification set forth below.

A connector assembly 10 for use with a mining cable coupler according to some embodiments is illustrated in FIG. 1. The connector assembly 10 includes a plug or pin connector 12 (also referred to as the male connector) and a receptacle or socket connector 14 (also referred to as the female connector).

The plug connector 12 has a body 12*b* that defines a longitudinal axis A1. The body 12*b* includes a front or mating portion 16, a rear or cable portion 18 and a central portion 20 between the front and rear portions 16, 18.

The front portion 16 includes a pin or plug 22. The plug 22 extends away from the central portion 20 along the longitudinal axis A1.

The rear portion 18 includes a barrel 24 which is a cylindrical portion that has a channel 26 defined therein. The channel 26 is sized and configured to receive a conductor end. A plurality of shear bolt apertures or holes 28 are defined in the barrel 24. The shear bolt holes 28 are sized and configured to receive shear bolts to secure the conductor end in the channel 26.

The socket connector 14 has a body 14*b* that defines a longitudinal axis A2. The body 14*b* includes a front or mating portion 36, a rear or cable portion 38 and a central portion 40 between the front and rear portions 36, 38.

The front portion 36 includes a socket 42 which is a tubular or cylindrical portion that has a channel 44 defined therein. The socket channel 44 is sized and configured to receive the plug 22 of the connector 12.

The rear portion 38 includes a barrel 54 which is a cylindrical portion that has a channel 56 defined therein. The channel 56 is sized and configured to receive a conductor end. A plurality of shear bolt apertures or holes 28 are defined in the barrel 54. The shear bolt holes 28 are sized and configured to receive shear bolts to secure the conductor end in the channel 56.

Figure 2:
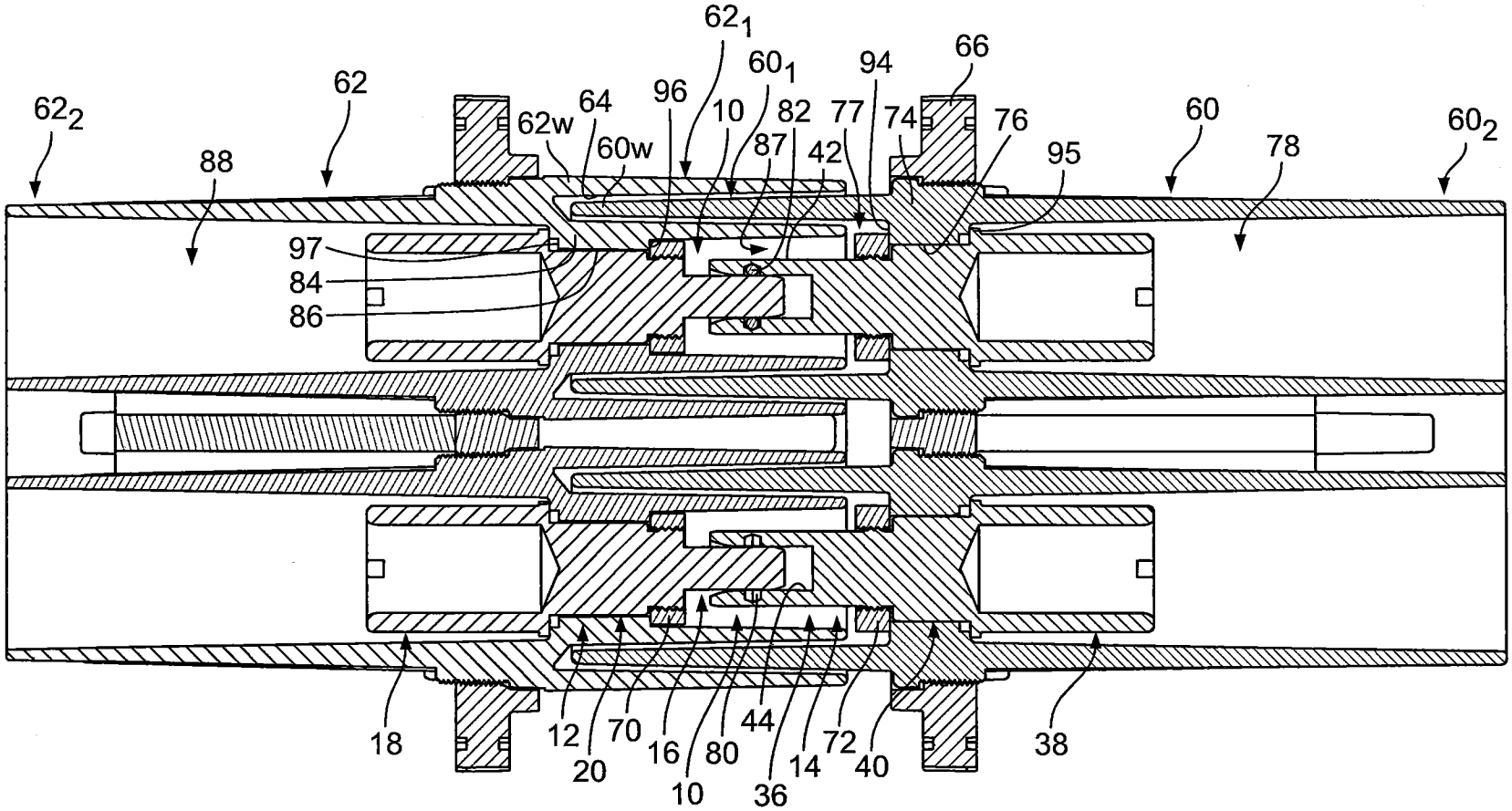
FIG. 2 is a sectional view of a mining cable coupler assembly including two of the connectors of FIG. 1.
Figure 3:
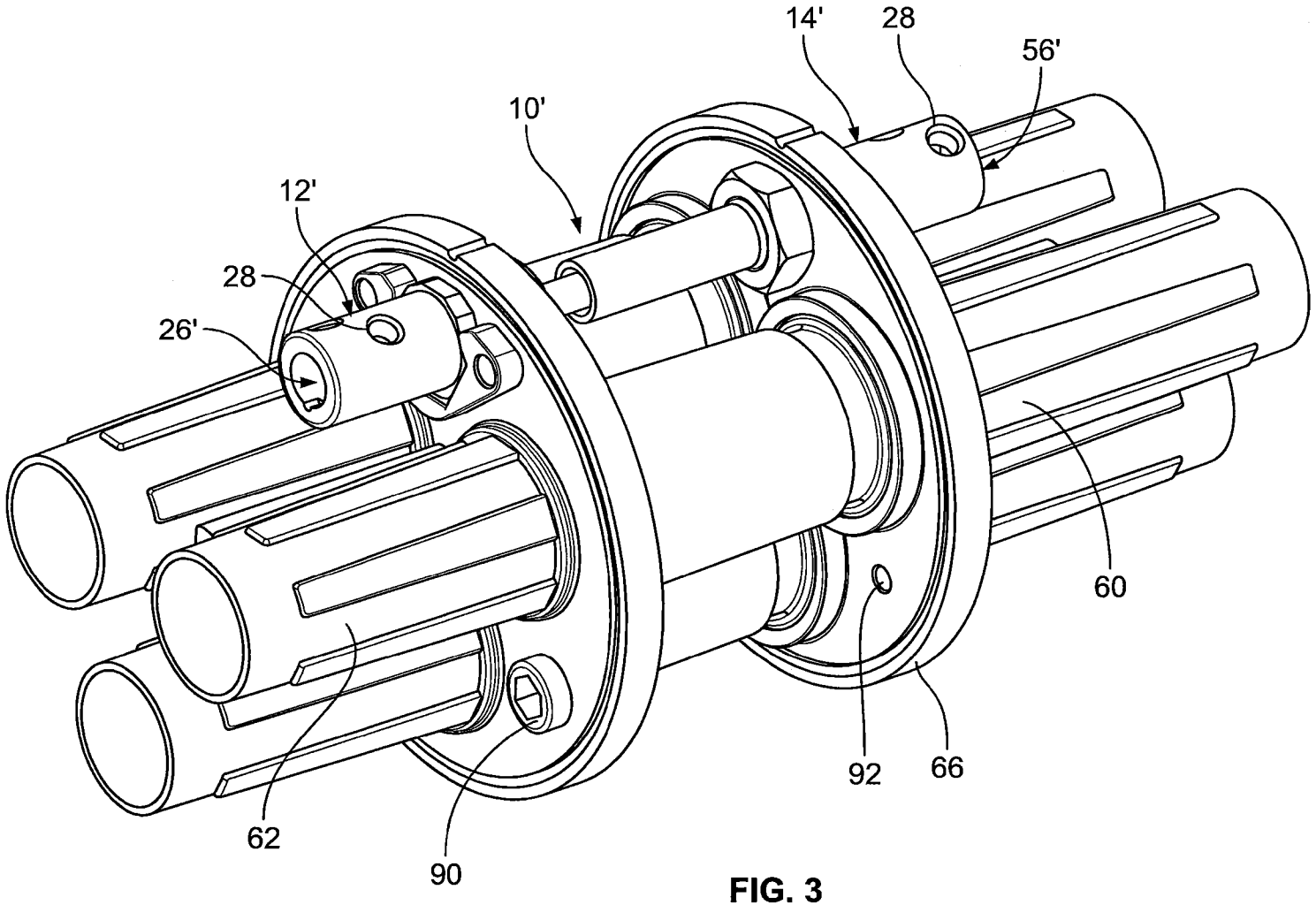
FIG. 3 is a perspective view of the mining cable coupler assembly of FIG. 2.

Further features of the connector assembly 10 are illustrated in FIG. 2. Two of the three phase conductor connector assemblies 10 are shown in the sectional view of FIG. 2. Each connector assembly 10 is held within a respective pair of tube-shaped housings 60, 62. The housing 62 includes an annular slot 64 that is sized and configured to receive an end portion of the housing 60. Base plates 66 hold the three pair of housings 60, 62 as shown in FIG. 3.

Referring to FIGS. 1 and 2, the connector central portions 20, 40 may have a stepped cylindrical configuration and may also include threaded portions 23, 43. Fasteners 70, 72 (e.g., hex nuts) may threadingly engage the threaded portions 23, 43, respectively. The stepped cylindrical configuration of the connector central portions 20, 40 and/or the fasteners 70, 72 may hold the connector assemblies 10 in the housings 60, 62.

Referring to FIG. 2, an annular groove or recess 80 is formed in the socket 42 of the connector 14. The groove 80 surrounds the channel 44 that is also defined in the socket 42. The groove 80 is sized and configured to receive and hold a ring-shaped annular spring 82. In some embodiments, the spring 82 is a canted coil spring.

Relative to known contact interfaces such as tulip type and louvertac band type interfaces, the configuration with the spring 82 provides improved contact area and contact pressure when the plug 22 of the plug connector 12 is received in the socket 42 of the socket connector 14. In addition, the mating (or insertion) force is reduced as compared to known contact interfaces such as the tulip type and louvertac band type interfaces. The plug connector 12 and the socket connector 14 with the spring 82 may be referred to herein as the annular spring contact type interface.

Figure 4A:
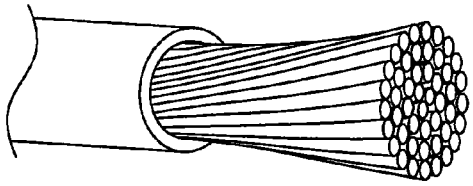
FIG. 4A illustrates a conductor end that is configured to be received in a barrel of the connector of FIG. 1.
Figure 4B:
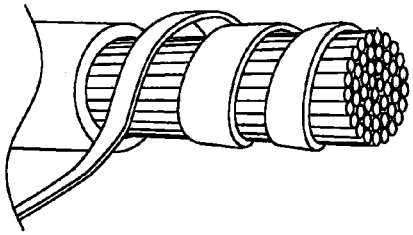
FIG. 4B illustrates the wrapping of shielding mesh around the conductor end of FIG. 4A.
Figure 4C:
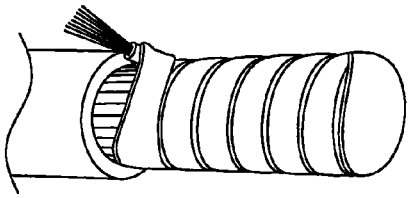
FIG. 4C illustrates securing the shielding mesh on the conductor end of FIG. 4A.

The assembly of a mining cable coupler will now be described. First, the conductor ends are stripped to the desired length as shown in FIG. 4A. A strip of copper shielding mesh is wrapped around the conductors as shown in FIG. 4B. In some embodiments, the shielding mesh is first folded over the cut end of the conductor and then tightly wrapped in a spiral motion around the fine strands of the conductor. As shown in FIG. 4C, the shielding mesh may be tied in a sharp knot to help ensure that the mesh does not move during installation. In this regard, a shielding mesh layer 25 is wrapped around the plurality of strands to secure the strands together.

Figure 5:
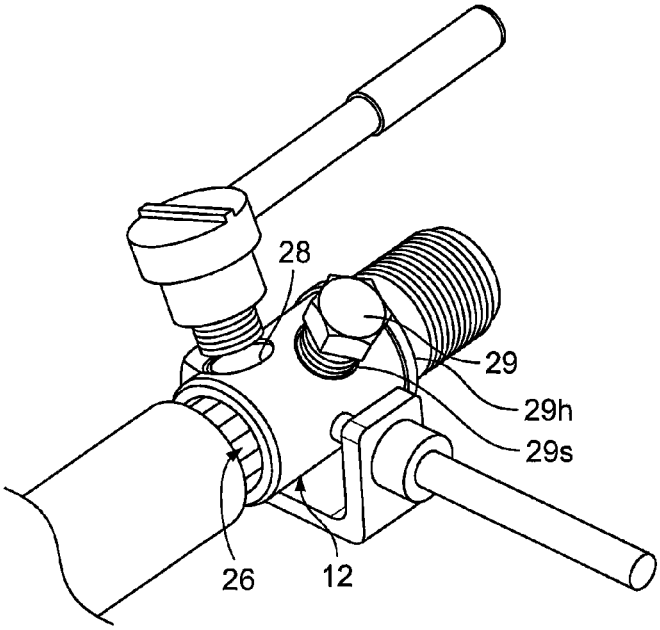
FIG. 5 illustrates the conductor end as prepared in FIG. 4C inserted in a barrel of the connector of FIG. 1 and the use of shear bolts to secure the conductor end in the barrel.

The prepared conductors are then inserted into the channels 26, 56 of the plug and socket connectors 12, 14. The conductor end is shown received in the channel 26 of the plug connector 12 in FIG. 5. Shear bolts 29 are received in the shear bolt holes 28. The shear bolts 29 are tightened (e.g., sequentially) until the bolt heads 29*h* shear off and the bolt threaded shanks 29*s* are left behind.

The present inventors discovered that the copper shielding mesh effectively contains the highly stranded conductor during insertion into the connector and also helps to ensure efficient current transfer during operation. The present inventors also discovered that the use of the shear bolts helps to ensure proper, repeatable contact pressure compared to techniques typically used with cable mining couplers such as soldering or using compression fittings.

The connectors 12, 14 with the conductors may be connected by inserting the plug 22 of the plug connector 12 in the socket 42 of the socket connector 14. As noted above, the insertion force is low due to the contact interface using the spring 82. The extraction force may be altered (e.g., increased) through contact design to improve retention of the plug.

The covers 60, 62 and the base plates 66 may be installed around the three phase conductor connectors 10 as shown in FIGS. 2 and 3. As shown in FIG. 3, a ground conductor connector assembly 10' may be held by the base plates 66. The connector 10' may be the same or substantially the same as the connector 10 described herein. The connector 10' includes a pin or plug connector 12' and a socket or receptacle connector 14'. One ground conductor may be received in a channel 26' of the pin connector 12' and another ground conductor may be received in a channel 56' of the socket connector 14'. The ground conductors may be secured with the proper contact pressure using shear bolts received in shear bolt holes 28. The connector 10' may include the same spring contact interface as the connector 10 allowing for low insertion force and a high and reliable contact area and/or pressure.

Although not shown, the mining cable coupler may also include a connector assembly for a pilot conductor. The pilot conductor connector assembly may be the same or similar to the phase conductor connector 10 and/or the ground conductor connector assembly 10' described herein. The pilot conductor connector assembly may be mounted to the base plates 66 using the mounting features 90, 92 (FIG. 3).

In addition, the mining cable coupler is typically enclosed in a shell as understood by those skilled in the art.

As noted above, the present inventors discovered that the spring contact interface provided substantial improvements in insertion force and electrical contact over known connectors used with mining cable couplers. The present inventors discovered that, due to the improved electrical contact area and/or pressure, the connectors according to embodiments described herein can be substantially smaller than known connectors used for mining cable couplers while maintaining the same ampacity.

Figure 6A:
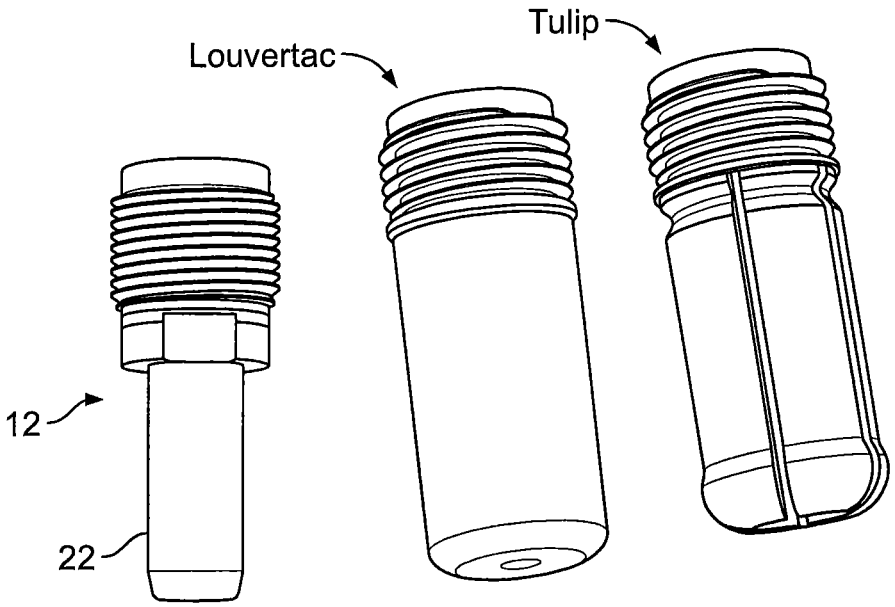
FIG. 6A is a side-by-side comparison of a plug connector of FIG. 1 with two known plug connectors used with mining cable couplers.
Figure 6B:
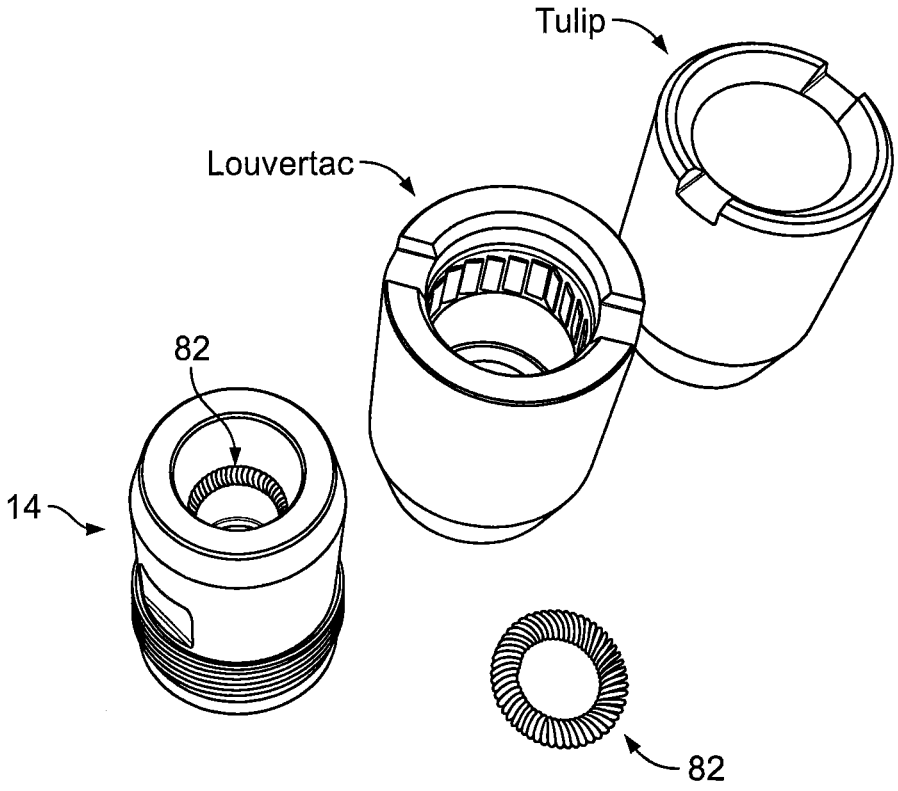
FIG. 6B is a side-by-side comparison of a socket connector of FIG. 1 with two known socket connectors used with mining cable couplers.

This is illustrated in FIGS. 6A and 6B. In FIG. 6A, the front and central portion of the plug connector 12 is juxtaposed with known plug connectors using the tulip style contact interface and the louvertac band style contact interface. The reduced diameter of the plug 22 is readily apparent.

In FIG. 6B, the front and central portion of the socket connector 14 is juxtaposed with known socket connectors using the tulip style contact interface and the louvertac band style contact interface. The diameter of the socket 42 is substantially reduced and corresponds to the reduction in diameter of the mating plug 22 (FIG. 6A).

The connector assembly 10 is lighter and cheaper to manufacture due to its reduced size. The smaller size of the connectors (e.g., at least three phase connectors, one ground connector and one pilot connector) may help increase the dielectric strength of the mining cable coupler by using additional insulation in the extra space.

In some embodiments, each of the plug connector 12 and the socket connector 14 are monolithic. That is, the connectors 12, 14 are each single-piece as opposed to known two-piece connectors used with mining cable couplers. This further reduces the size of the connector. Moreover, the single-piece connectors are easier to assemble, install and service and may also be more reliable due to the reduced part count.

In some embodiments, the spring 82 can be removed and replaced. In this sense, the connector assembly 10 can be serviced in the event the spring 82 is worn or otherwise damaged (e.g., due to handing).

Referring to FIG. 1, the plug 22 of the plug connector 12 may have a diameter D1 of between about 0.25 and 3 inches, between about 0.25 and 1 inch, and, in some embodiments, has a diameter D1 of about 0.5 inches. The socket 42 of the socket connector 14 may have a diameter D2 of between about 0.5 and 5 inches, between about 0.5 and 2 inches, and, in some embodiments, has a diameter D2 of about 1.125 inches. The socket channel 44 of the socket connector 14 may have a diameter of between about 0.5 and 5 inches, between about 0.5 and 2 inches, and, in some embodiments, has a diameter of about 1.125 inches. The plug connector 12 may have a length L1 of between about 2 and 10 inches, between about 4 and 6 inches, and, in some embodiments, has a length L1 of about 5 inches. The socket connector 14 may have a length L2 of between about 2 and 10 inches, between about 4 and 6 inches, and, in some embodiments, has a length L2 of about 5 inches. When the connectors 12, 14 are coupled, the coupled connectors have a total length of between about 8 and 12 inches and, in some embodiments, have a total length of about 10 inches.

The connectors 12, 14 may be made of any suitable electrically conductive material. An exemplary suitable material for the connectors 12, 14 is copper.

The housings 60, 62 may be made of any suitable electrically insulating material. In some embodiments, the housings 60, 62 are polymeric.

The spring 82 may be made of any suitable electrically conductive material. An exemplary suitable material for the spring 82 is copper.

In some embodiments, the spring 82 is silver plated. Connectors typically used with mining cable couplers (e.g., the connectors using the tulip style or louvertac band style contact interfaces described above) have the entire front or "mating" portion silver plated to address oxidation concerns. With the connector assembly 10, the spring serves as the primary electrical contact while the rest of the connector provides mechanical support and path for current flow. In some embodiments, only the spring 82 is silver plated. In some embodiments, only the spring 82 and a portion of the plug 22 are silver plated. Substantial cost savings may be realized by not silver plating the connectors 12, 14 or a substantial portion of the connectors 12, 14. Other plating materials are contemplated. For example, the spring 82 and/or a portion of the plug 22 may be tin or gold plated.

Figure 9:
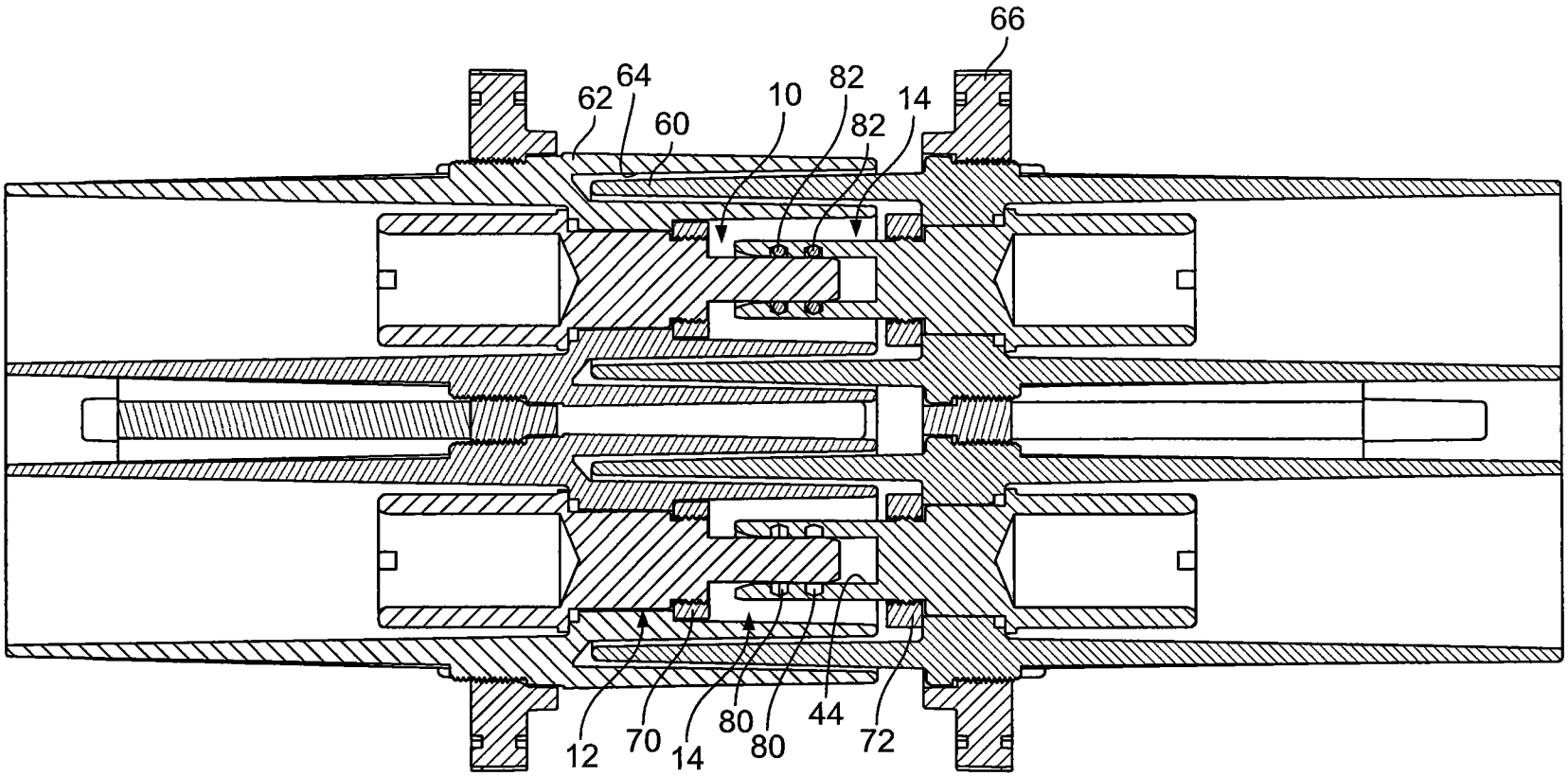
FIG. 9 is a sectional view of a mining cable coupler assembly according to some other embodiments.

Although the connector assembly 10 has been described as having one spring 82, it is contemplated that more than one spring may be used. That is, as illustrated in FIG. 9, the socket 42 may have two or more spaced apart annular grooves 80 that surround the channel 44 (FIG. 2) and a spring 82 may be received in each one of the grooves 80. The use of multiple springs provides increased contact area and may reduce the size of the connectors even further. In addition, the use of multiple springs may be desirable for high current applications (e.g., the multiple springs provide increased contact area for higher current applications).

It is contemplated that the spring(s) 82 could be located on the outside diameter of the plug 22 instead of the inside diameter of the socket 42. For example, one or more grooves may be formed in the outer surface of the plug 22 with each groove sized and configured to receive and hold one of the springs 82.

It is also contemplated that the spring design and/or the groove design may be varied to vary the insertion and holding forces. For example, the size and/or shape of the spring 82 and/or the size and/or shape of the groove 80 may be varied for a range of insertion and holding forces. In addition, the plug and/or the socket (e.g., the spring) may be configured to have a locking function. For example, the plug 22 may lock in the socket 42 when inserted therein in a first direction. The plug 22 and socket 42 may be unlocked by further advancing the plug 22 in the first direction a small distance, at which point the plug 22 may be withdrawn from the socket 42 in a second direction that is opposite the first direction.

Figure 7:
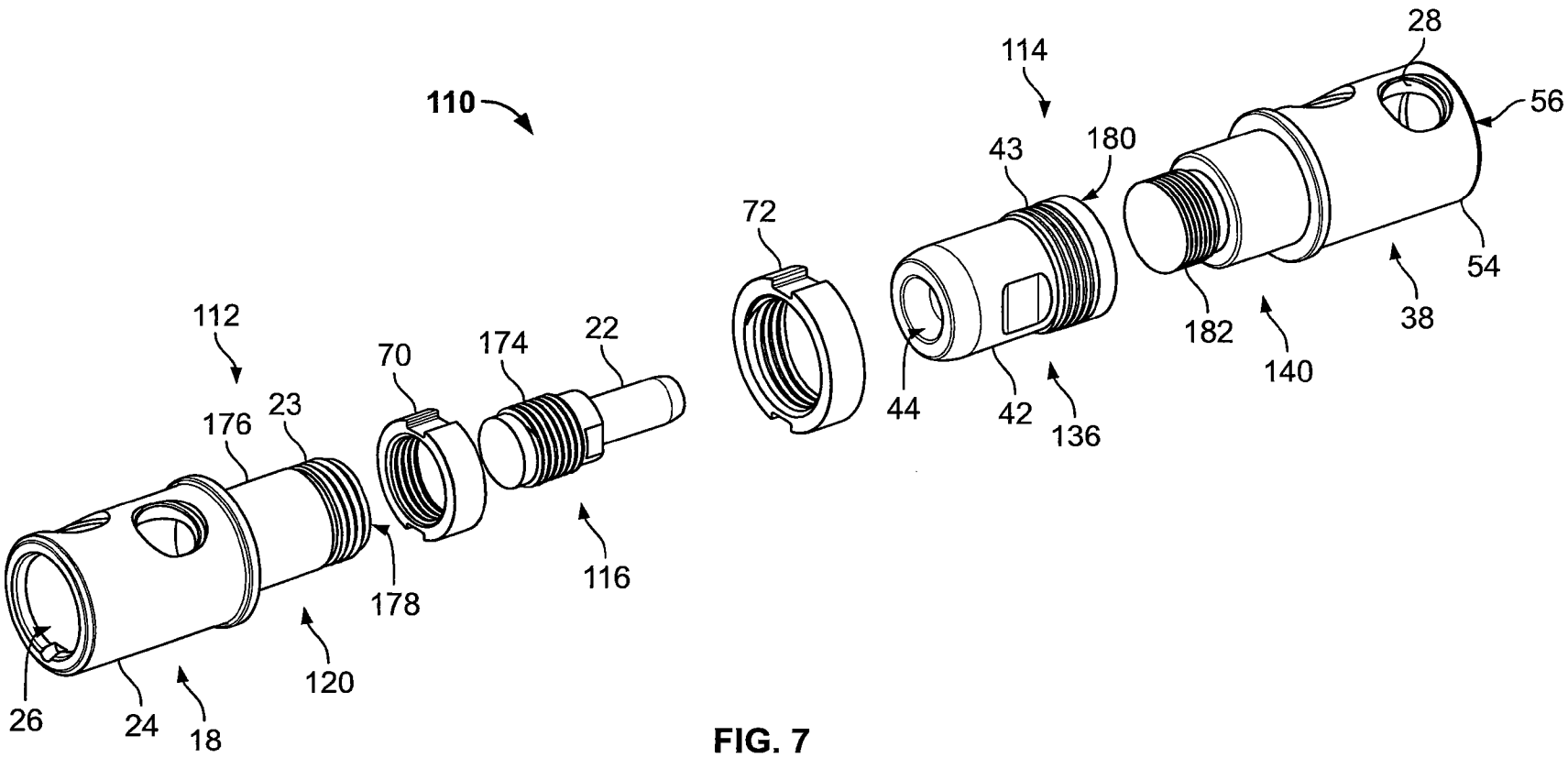
FIG. 7 is an exploded perspective view of a mining cable coupler connector according to some other embodiments.

A connector assembly 110 for use with mining cable couplers according to some other embodiments is illustrated in FIG. 7. The connector 110 includes some features that are the same or substantially the same as the connector 10; these features include like reference numbers and the description will not be repeated below in the interest of brevity.

The connector assembly 110 includes a two-piece plug or pin connector 112 and a two-piece receptacle or socket connector 114. A front portion 116 of the plug connector 112 includes the plug 22 that extends away from a threaded fitting 174. A central portion 120 of the plug connector 116 includes a cylindrical portion 176 with a channel 178 defined therein. The channel 178 is sized and configured to receive the fitting 174. The fitting 174 and the channel 178 may threadingly engage one another such that the front portion 116 and the central portion 120 are securely held together.

A front portion 136 of the socket connector 114 includes the socket 42 which is a cylindrical member that has a channel 180 defined therein opposite the socket channel 44. A central portion 140 of the socket connector 114 includes a threaded fitting 182. The channel 180 is sized and configured to receive the fitting 182. The fitting 182 and the channel 180 may threadingly engage one another such that the front portion 136 and the central portion 140 are securely held together.

Figure 8:
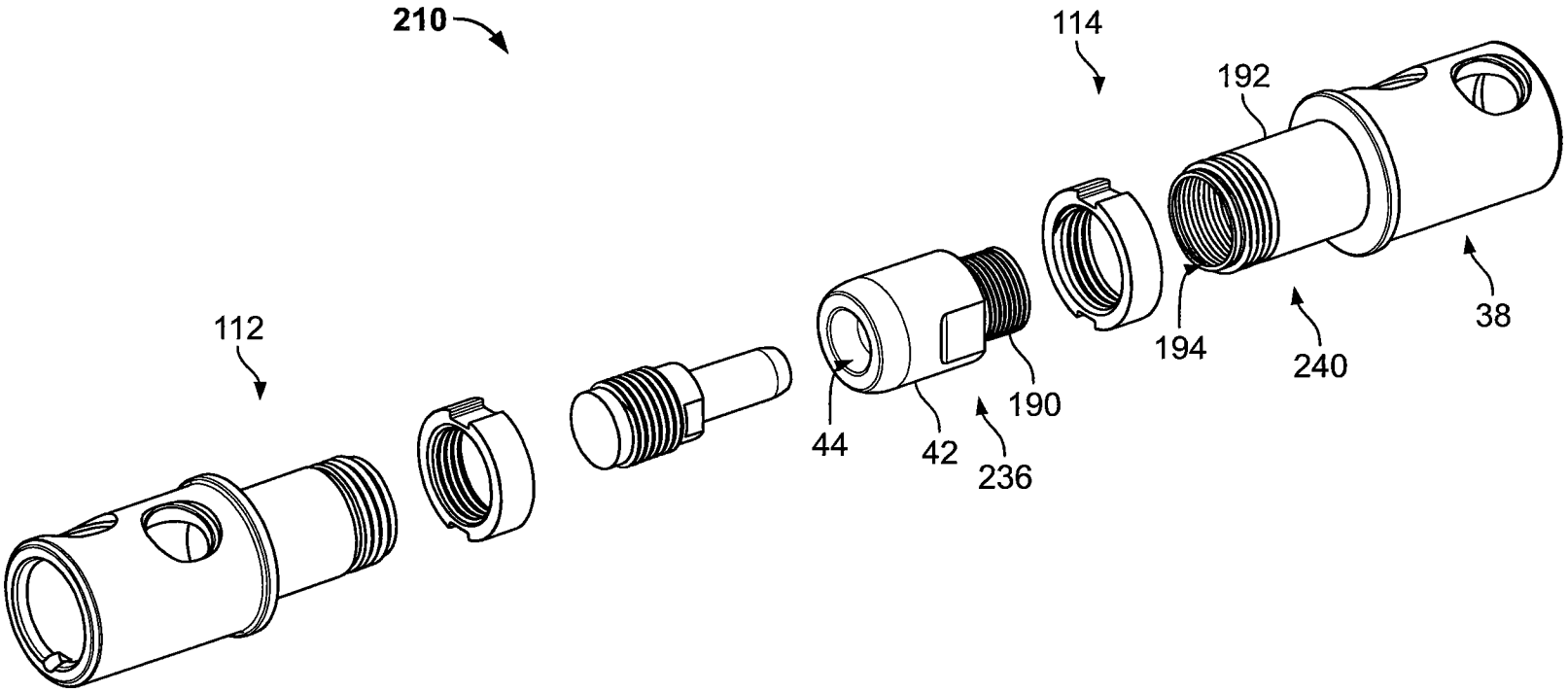
FIG. 8 is an exploded perspective view of a mining cable coupler connector according to some other embodiments.

A connector assembly 210 for use with mining cable couplers according to some other embodiments is illustrated in FIG. 8. The connector assembly 210 includes the same plug connector 112 as the connector 110. The connector 210 includes a different socket connector 214 as will now be described.

A front portion 236 of the socket connector 214 includes the socket 42 and a threaded fitting 190 opposite the socket channel 44. A central portion 240 of the socket connector 214 includes a cylindrical portion 192 with a channel 194 defined therein. The channel 194 is sized and configured to receive the fitting 190. The fitting 190 and the channel 194 may threadingly engage one another such that the front portion 236 and the central portion 240 are securely held together.

The connectors 110, 210 may include the spring contact interface on the "front end" and/or the shear bolt cable securing mechanism on the "back end" as described above in connection with the connector 10. The two-piece design may be useful for end users that already have a two-piece design but would like to replace at least one of the pieces to take advantage of at least one of these features.

A female to female connector is contemplated. For example, a female (socket) connector similar to the socket member 42 could be connected to the socket member 42 (e.g., using the threading 43 shown in FIG. 7 or the fitting 190 shown in FIG. 8). In this regard, the connector has oppositely facing socket portions which may each include the spring contact interface. This may be advantageous to reduce the number of components. For example, male (plug) connectors could be on the conductor ends and the female to female connector could provide a compact junction for mating in the field.

It is noted that while the connectors 10, 110, 210 illustrate the use of shear bolts on the rear portions, it is contemplated that the conductors may be secured in the connectors in other ways. For example, the rear end portion of the connector may be a smooth barrel to accommodate soldering the connector and the conductor. In some other embodiments, compression fittings such as hex nuts may be used.

Referring again to FIG. 2, the relationship between the connectors 12, 14 and the housings 60, 62 will now be described in greater detail. The housings 60, 62 may collectively be referred to as the outer housing. The first housing 60 is a generally tube shaped housing having an outer wall 60*w* and first and second opposite ends $\mathbf{60}_1$, $\mathbf{60}_2$. The second housing 62 is also a generally tube shaped housing having an outer wall 62*w* and first and second opposite ends $\mathbf{62}_1$, $\mathbf{62}_2$. An elongated annular groove or slot 64 is defined in the outer wall 62*w* of the second housing 62. The first end $\mathbf{60}_1$ of the first housing 60 is received and held in the annular slot 64.

An annular projection or step 74 extends inwardly from the outer wall 60*w* between the first and second ends $\mathbf{60}_1$, $\mathbf{60}_2$ of the first housing 60. A central channel 76 is defined by the annular projection 74. A first end channel 77 is defined by the outer wall 60*w* of the first housing 60 between the first end $\mathbf{60}_1$ of the first housing 60 and the annular projection 74. A second end channel 78 is defined by the outer wall 60*w* of the first housing 60 between the second end $\mathbf{60}_2$ of the first housing 60 and the annular projection 74.

Similarly, an annular projection or step 84 extends inwardly from the outer wall 62*w* between the first and second ends $\mathbf{62}_1$, $\mathbf{62}_2$ of the second housing 62. A central channel 86 is defined by the annular projection 84. A first end channel 87 is defined by the outer wall 62*w* of the second housing 62 between the first end $\mathbf{62}_1$ of the second housing 62 and the annular projection 84. A second end channel 88 is defined by the outer wall 62*w* of the second housing 62 between the second end $\mathbf{62}_2$ of the second housing 62 and the annular projection 84.

As illustrated in FIG. 2, the socket connector 14 is held in the first housing 60. The front portion 36 of the socket connector 14 is in the first end channel 77 of the first housing 60 and/or the first end channel 87 of the second housing 62. The central portion 40 of the socket connector 14 is in the central channel 76 of the first housing 60. The rear end portion 38 of the socket connector 14 is in the second end channel 78 of the first housing 60.

As also illustrated in FIG. 2, the plug connector 12 is held in the second housing 62. The front portion 16 of the plug connector 12 is in the first end channel 87 of the second housing 62 and/or the first end channel 77 of the first housing 60. The central portion 20 of the plug connector 12 is in the central channel 86 of the second housing 62. The rear end portion 18 of the plug connector 12 is in the second end channel 88 of the second housing 62.

The fastener 72 coupled to the socket connector 14 may be adjacent and/or abut a first wall 94 defined by annular projection 74. The rear portion 38 of the socket connector 14 may be adjacent and/or abut a second, opposite wall 95 defined by the annular projection 74. Similarly, the fastener 70 coupled to the plug connector 12 may be adjacent and/or abut a first wall 96 defined by annular projection 84. The rear portion 18 of the plug connector 12 may be adjacent and/or abut a second, opposite wall 97 defined by the annular projection 84.

It will be appreciated that other configurations are contemplated. For example, the plug connector 12 may be in the first housing 60 and the socket connector 14 may be in the second housing 62. These configurations help provide a secure connection between the connectors 12, 14 and/or the housing 60, 62.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention. Therefore, it is to be understood that the foregoing is illustrative of the present invention and is not to be construed as limited to the specific embodiments disclosed, and that modifications to the disclosed embodiments, as well as other embodiments, are intended to be included within the scope of the invention.

What is claimed is:

1. A connector assembly for use with a mining cable coupler, the assembly comprising:

a first connector comprising a front portion including a plug and a rear portion including a barrel configured to receive a first conductor;

a second connector comprising a front portion including a socket having a channel defined therein and a rear portion including a barrel configured to receive a second conductor, wherein an annular groove is defined in an inner surface of the channel; and an annular spring held in the annular groove;

wherein the channel is sized and configured to receive the plug such that the plug resiliently contacts the spring to electrically connect the first conductor received in the first connector barrel and the second conductor received in the second connector barrel;

the connector assembly in combination with:

the first conductor comprising a first conductor end held in the first connector barrel; and the second conductor comprising a second conductor end held in the second connector barrel;

wherein:

each of the first and second conductor ends comprises a plurality of strands; and a shielding mesh layer is wrapped around the plurality of strands of each of the first and second conductor ends to secure the strands together.

2. The connector assembly of claim 1 wherein each of the first and second connectors is monolithic.

3. The connector assembly of claim 2 wherein:

the first connector comprises a central portion between the front portion and the rear portion, the central portion comprising a threaded region on an outer surface thereof, the threaded region configured to threadingly engage with a fastener such that the fastener is held around the central portion of the first connector; and the second connector comprises a central portion between the front portion and the rear portion, the central portion comprising a threaded region on an outer surface thereof, the threaded region configured to threadingly engage with a fastener such that the fastener is held around the central portion of the second connector.

4. The connector assembly of claim 1 wherein each of the first and second connector barrels comprise a plurality of shear bolt holes configured to receive shear bolts for securing the first and second conductor ends in the first and second connector barrels, respectively.

5. The connector assembly of claim 1 wherein the spring is a canted coil spring.

6. The connector assembly of claim 1 wherein the spring is silver-plated.

7. The connector assembly of claim 1 wherein a plurality of spaced apart annular grooves are defined in the inner surface of the socket channel and a spring is held in each of the plurality of annular grooves.

8. The connector assembly of claim 1 wherein:

the first connector comprises a central portion between the front portion and the rear portion and the front portion and central portion are threadingly engaged with one another; and the second connector comprises a central portion between the front portion and the rear portion and the front portion and central portion are threadingly engaged with one another.

9. A mining cable coupler assembly comprising:

an outer housing comprising:

a first tube shaped housing having first and second opposite ends;

a second tube shaped housing having first and second opposite ends with an elongated annular slot defined in an outer wall of the second housing at the first end;

wherein the first and second housings are coupled at least in part by the first end of the first housing being received in the annular slot of the second housing;

a first connector held in the first housing; and a second connector held in the second housing;

wherein:

the first connector comprises a rear portion including a barrel configured to receive a first conductor, a front portion comprising one of a plug and a socket, and a central portion between the rear portion and the front portion;

the second connector comprises a rear portion including a barrel configured to receive a second conductor, a front portion comprising the other one of a plug and a socket, and a central portion between the rear portion and the front portion;

the first and second connectors are coupled by the plug of one of the first and second connectors being received in the socket of the other one of the first and second connectors.

10. The mining cable coupler assembly of claim 9 wherein:

the first housing comprises an annular projection extending inwardly from an outer wall between the first and second ends, a central channel defined by the annular projection, a first end channel defined by the outer wall between the first end and the annular projection, and a second end channel defined by the outer wall between the second end and the annular projection; and the second housing comprises an annular projection extending inwardly from the outer wall between the first and second ends, a central channel defined by the annular projection, a first end channel defined by the outer wall between the first end and the annular projection, and a second end channel defined by the outer wall between the second end and the annular projection.

11. The mining cable coupler assembly of claim 10 wherein:

the first connector is held in the first housing with the front portion of the first connector in the first end channel of the first housing and/or the first end portion of the second housing, the central portion of the first connector in the central channel of the first housing, and the rear portion of the first connector in the second end channel of the first housing; and the second connector is held in the second housing with the front portion of the second connector in the first end channel of the second housing and/or the first end portion of the first housing, the central portion of the second connector in the central channel of the second housing, and the rear portion of the second connector in the second end channel of the second housing.

12. The mining cable coupler assembly of claim 11 wherein:

each of the first and second connectors is a one-piece connector;

the central portion of the first connector includes a threaded region on an outer surface thereof and a first fastener is threadingly engaged with the threaded region; and the central portion of the second connector includes a threaded region on an outer surface thereof and a second fastener is threadingly engaged with the threaded region.

13. The mining cable coupler assembly of claim 12 wherein:

the first fastener is adjacent and/or abuts a first wall defined by the annular projection of the first housing and the rear portion of the first connector is adjacent and/or abuts a second, opposite wall of the annular projection of the first housing; and the second fastener is adjacent and/or abuts a first wall defined by the annular projection of the second housing and the rear portion of the second connector is adjacent and/or abuts a second, opposite wall of the annular projection of the second housing.

14. The mining cable coupler assembly of claim 11 comprising a plurality of the outer housings with one of the first connectors and one of the second connectors coupled and held in each one of the outer housings, wherein the plurality of outer housings are held together by a first base plate that engages the outer wall of each of the first housings and a second base plate that engages the outer wall of each of the second housings.

15. The mining cable coupler assembly of claim 9 wherein:

the socket of one of the first and second connectors comprises a channel with an annular groove defined in an inner wall of the channel;

a spring is held in the annular groove; and the plug of the other one of the first and second connectors resiliently contacts the spring to electrically connect the first conductor received in the first connector barrel and the second conductor received in the second connector barrel.

16. A method for electrically connecting mining cables, the method comprising:

(a) providing:

a first connector comprising a front portion including a plug and a rear portion including a barrel;

a second connector comprising a front portion including a socket having a channel defined therein and a rear portion including a barrel, wherein an annular groove is defined in an inner surface of the channel;

an annular spring held in the annular groove;

a first tube shaped housing having first and second opposite ends with an elongated annular slot defined in an outer wall of the first housing at the first end;

a second tube shaped housing having first and second opposite ends;

(b) receiving a first mining cable conductor in the barrel of the first connector;

(c) securing the first mining cable conductor in the barrel of the first connector;

(d) inserting the first connector with the secured first mining cable conductor into the second end of the first housing toward the first end of the first housing such that the plug is adjacent the first end of the first housing;

(e) receiving a second mining cable conductor in the barrel of the second connector;

(f) securing the second mining cable conductor in the barrel of the second connector;

(g) inserting the second connector with the secured second mining cable conductor into the second end of the second housing toward the first end of the second housing such that the socket is adjacent the first end of the second housing;

(h) coupling the first and second housings including receiving the first end of the second housing in the annular slot of the first housing; and (i) coupling the first and second connectors including receiving the plug of the first connector in the socket of the second connector such that the plug resiliently contacts the spring to electrically connect the first mining cable conductor and the second mining cable conductor.

17. The method of claim 16 further comprising wrapping a shielding mesh layer around the first cable mining cable conductor before step (b) and wrapping a shielding mesh layer around second cable mining cable conductor before step (e), wherein securing the first mining cable conductor in the barrel of the first connector comprises receiving shear bolts through shear bolt apertures defined in the barrel of the first connector and tightening the shear bolts, and wherein securing the second mining cable conductor in the barrel of the second connector comprises receiving shear bolts through shear bolt apertures defined in the barrel of the second connector and tightening the shear bolts.

18. The method of claim 16 further comprising:

providing:

three of the first connectors;

three of the second connectors;

three of the annular springs, one each held in a respective annular groove of a respective second connector;

three of the first tube shaped housings; and three of the second tube shaped housings;

performing steps (b) through (i) for each of the first connectors, second connectors, first housings, and second housings;

securing the first housings with a first base plate that engages outer surfaces of the first housings; and securing the second housings with a second base plate that engages outer surfaces of the second housings.

* * * * *